US008821053B2

(12) United States Patent
Nakayama

(10) Patent No.: US 8,821,053 B2
(45) Date of Patent: Sep. 2, 2014

(54) PAPER DISCHARGE GUIDE WITH PROTRUDING PART FOR SUPPORTING PAPER AT AN ANGLE

(75) Inventor: Ichiro Nakayama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 95 days.

(21) Appl. No.: 13/469,687

(22) Filed: May 11, 2012

(65) Prior Publication Data

US 2012/0288318 A1 Nov. 15, 2012

(30) Foreign Application Priority Data

May 13, 2011 (JP) ..... 2011-107941

(51) Int. Cl.
*B41J 11/70* (2006.01)
*B41J 13/10* (2006.01)

(52) U.S. Cl.
USPC ..... 400/621; 400/646; 271/207

(58) Field of Classification Search
CPC ..... B41J 11/70; B41J 11/703; B41J 11/66; B26D 1/085; B65H 2404/511; B65H 2404/521; B65H 2404/141; B65H 2301/332112; B65H 29/52
USPC ..... 400/621, 642, 646; 271/188, 209, 207, 271/220
See application file for complete search history.

(56) References Cited

U.S. PATENT DOCUMENTS

| | | | | | |
|---|---|---|---|---|---|
| 5,413,426 | A * | 5/1995 | Ijuin et al. | ..... | 400/621 |
| 5,890,822 | A * | 4/1999 | Saikawa et al. | ..... | 400/647.1 |
| 2010/0008710 | A1 * | 1/2010 | Conway et al. | ..... | 400/223 |

FOREIGN PATENT DOCUMENTS

| | | | | | |
|---|---|---|---|---|---|
| JP | 05116400 | A * | 5/1993 | ..... | B41J 11/66 |
| JP | 06009124 | A * | 1/1994 | ..... | B65H 20/04 |
| JP | 08197723 | A * | 8/1996 | ..... | B41J 2/01 |
| JP | 2001113495 | A | 4/2001 | | |
| JP | 2004268207 | A | 9/2004 | | |
| JP | 2007076911 | A * | 3/2007 | ..... | B65H 29/70 |
| JP | 2008105801 | A * | 5/2008 | ..... | B41J 11/70 |

OTHER PUBLICATIONS

European Search Report, Application No. EP 12165729, Aug. 31, 2012.

* cited by examiner

*Primary Examiner* — Daniel J Colilla
(74) *Attorney, Agent, or Firm* — Lowe Hauptman & Ham, LLP

(57) ABSTRACT

A paper discharge device has a paper feed mechanism configured to convey recording paper; an automatic cutter that has a drive unit and configured to cut the recording paper conveyed by the paper feed mechanism into a slip by drive power from the drive unit; and a paper guide unit that has a paper guide surface configured to support the slip cut by the automatic cutter, and a protruding part that is disposed proximate to the guide surface and supports part of the cut end of the slip at a position configured to cause the part of the cut end to contact the recording paper conveyed by the paper feed mechanism.

16 Claims, 6 Drawing Sheets

PAPER DISCHARGE GUIDE WITH PROTRUDING PART FOR SUPPORTING PAPER AT AN ANGLE

RELATED APPLICATIONS

The present application is based on, and claims priority from, Japanese Application Number JP2011-107941, filed May 13, 2011, the disclosure of which is hereby incorporated by reference herein in its entirety.

TECHNICAL FIELD

The present disclosure relates to a paper discharge device that discharges recording paper that is cut into slips after recording information, to a paper discharge method, and to a printer having the paper discharge device.

BACKGROUND

Printers with an automatic cutter are used in many fields, including sales and distribution. Such printers produce slips by printing information on continuous recording paper and then cutting the recording paper to a specific length. The automatic cutter is located at the downstream end of the conveyance path leading past the printing position to the paper exit. The cut recording paper (slip) is then discharged from the paper exit. The automatic cutter is typically a scissor type that causes a movable knife to pivot to and away from a fixed knife, or a type that moves the movable knife to and away from the fixed knife in a reciprocating linear motion.

These printers include printers that have the automatic cutter disposed near the paper exit and hold the cut slip temporarily at the paper exit for the operator to remove and hand to the customer. See, for example, Japanese Unexamined Patent Appl. Pub. JP-A-2004-268207. Printers that have a conveyance unit that conveys the cut slip and discharges the slip from the printer by means of the conveyance unit are also known. See, for example, Japanese Unexamined Patent Appl. Pub. JP-A-2001-113495.

However, if the operator forgets to remove the slip from the printer taught in JP-A-2004-268207, slips left in the paper exit gradually accumulate. As slips accumulate, the slips may interfere with the cutting edge of the movable knife, resulting in improper cutting or the accumulated slips being cut again, producing small slivers of paper, and printer operation may be adversely affected.

A problem with the printer having a continuous paper cutter mechanism described in JP-A-2001-113495 is that use of a conveyance unit for the cut slips complicates printer construction and increases printer size.

SUMMARY

A paper discharge device that cuts continuous recording paper on which information is recorded and produces slips has a paper feed mechanism that conveys the continuous recording paper through a paper conveyance path, an automatic cutter that cuts the recording paper after information is printed thereon into slips of a specific length, and a paper guide surface that is located downstream on the paper conveyance path from the automatic cutter and supports the bottom of the slip. The paper guide surface has a step that is lower than where the recording paper passes horizontally, and a protruding part that protrudes toward the slip at a position outside the widthwise center part of the slip. The slip cut by the automatic cutter is supported by the guide surface and the protruding part so that the upstream cut end of the slip blocks part of the path of the recording paper conveyed by the paper feed mechanism.

In this configuration, the slip is supported on the paper guide surface at an angle by the paper guide surface and the protruding part so that part of the path of the recording paper conveyed by the paper feed mechanism is blocked. Subsequently, when the recording paper is fed by the paper feed mechanism, the leading end of the recording paper can push against the upstream cut end of the slip. As a result, the slip is pushed out from near the automatic cutter and the paper guide surface, and discharged. Slips can therefore be discharged without using a special mechanism, and incomplete cutting and production of paper slivers by the automatic cutter can be reduced.

In a paper discharge device according to another aspect of the disclosure, the protruding part is shaped like a bottom of a boat advancing in the paper conveyance direction. This configuration reduces the conveyance load of the recording paper, and enables consistent paper conveyance.

In a paper discharge device according to another aspect of the disclosure, the protruding part is a wheel that rotates freely in the paper conveyance direction. This configuration reduces the conveyance load of the recording paper, and enables consistent paper conveyance.

In a paper discharge device according to another aspect of the disclosure, the protruding part is a hemispheric protrusion. This configuration reduces the conveyance load of the recording paper, and enables consistent paper conveyance.

A paper discharge device according to another aspect of the disclosure also has a stacker that can hold a plurality of slips downstream in the paper conveyance direction from the paper guide surface, and the slips are pushed from the paper guide surface and stored in the stacker by the paper feed mechanism conveying the recording paper. By adjusting the paper feed distance of the recording paper by the paper feed mechanism, this configuration enables the slips to reach the stacker and be reliably stored in the stacker.

A paper discharge method that cuts continuous recording paper on which information is recorded and produces slips has a paper feed step that conveys the continuous recording paper through a paper conveyance path; a paper cutting step that cuts the recording paper after information is printed thereon into slips of a specific length; a paper supporting step that supports the slip by a paper guide surface and a protruding part disposed to the paper guide surface located downstream on the paper conveyance path from an automatic cutter so that the upstream cut end of the slip blocks part of the path of the recording paper conveyed by the paper feed step; a paper discharge step that discharges the slip to the outside by the recording paper conveyed by the paper feed step pushing the slip supported in the paper supporting step; and a reverse feed step that returns the recording paper conveyed in the paper discharge step to the upstream side of the automatic cutter.

As a result, the slip produced in the paper cutting step is supported in the paper supporting step by the paper guide surface and the protruding part so that part of the path of the recording paper conveyed by the paper feed step is blocked. The leading end of the conveyed recording paper can reliably push against the upstream cut end of the slip in the paper discharge step, and the slip can be discharged to the outside. In addition, the recording paper is returned to the original position after the slip is discharged. Slips can therefore be discharged without using a special mechanism, and incomplete cutting and production of paper slivers by the automatic cutter can be reduced.

Another aspect of the disclosure is a printer having a printhead that prints information on continuous recording paper, and the paper discharge device described above disposed downstream on the paper conveyance path from the printhead. This aspect of the disclosure provides a high reliability printer that can dependably discharge slips on which information is printed.

DESCRIPTION OF EMBODIMENTS

A preferred embodiment of the present disclosure is described below with reference to the accompanying figures. Note that in the figures referenced below the horizontal and vertical scale of members and parts may differ from the actual scale for convenience of description and illustration.

Figure 1:
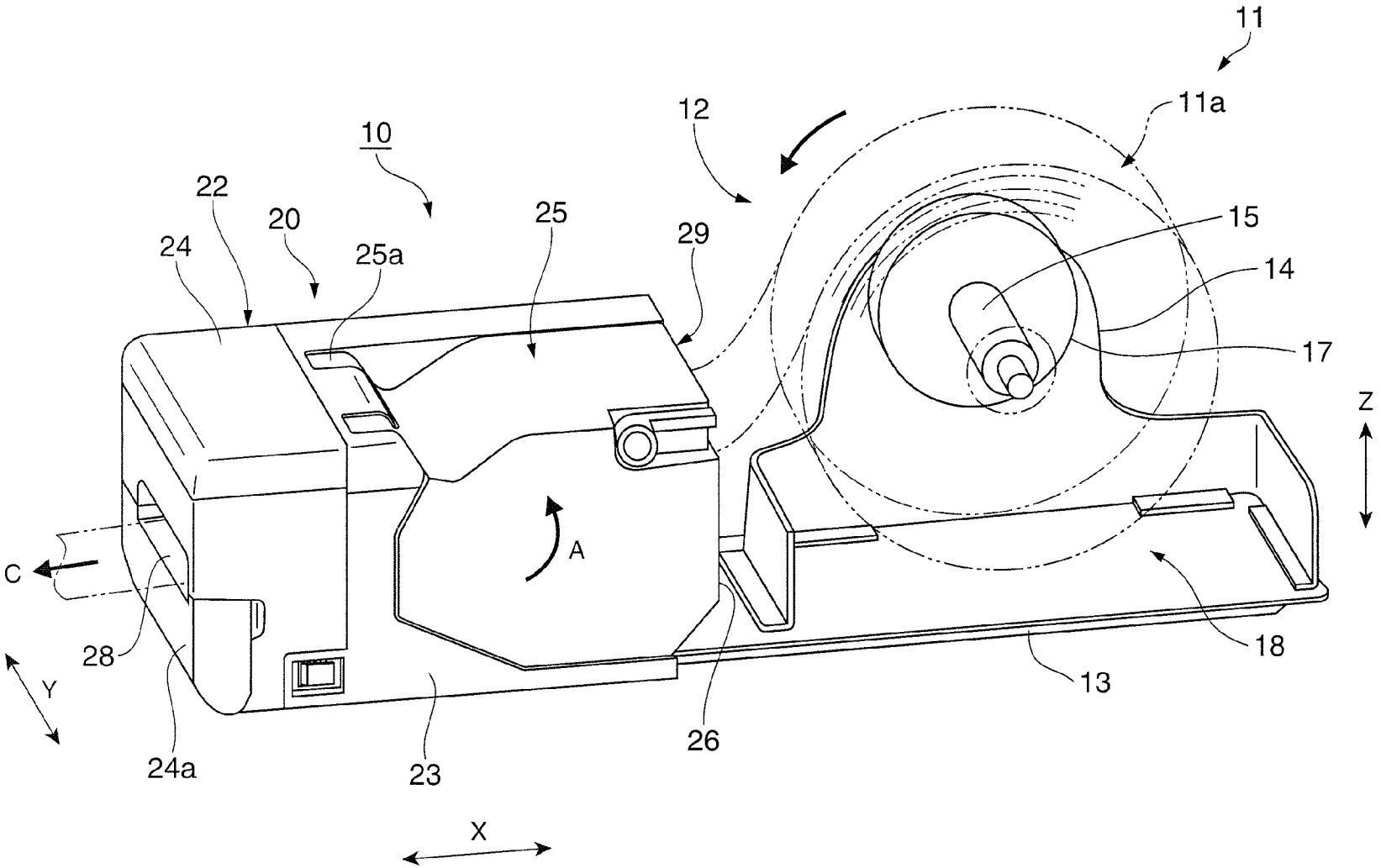
FIG. 1 shows a printer system.

A printer system 10 using a printer according to an embodiment of the disclosure is described with reference to FIG. 1. FIG. 1 schematically shows a printer system 10 according to this embodiment of the disclosure. The x-axis in FIG. 1 denotes the conveyance direction of the recording paper 11 used in the printer system 10, and the y-axis denotes the direction of the recording paper width. The z-axis is the vertical axis perpendicular to the x-axis and y-axis.

As shown in FIG. 1, the printer system 10 includes a paper feed unit 12 and a printer 20. The paper feed unit 12 has a base plate 13 that is removably connectable to the printer 20. A paper holder 14 that is enclosed on three sides by a rectangular member with the long side of the rectangular member rising vertically is attached to the base plate 13. A roll paper spindle 15 is attached horizontally to a place at the top of the long side of the paper holder 14.

The paper feed unit 12 can supply either roll paper 11*a* having continuous recording paper wound in a roll, or fanfold paper not shown having continuous recording paper folded and stacked in sheets of a specific length, selectively stored therein as the recording paper 11.

When roll paper 11*a* is used, the roll paper 11*a* is installed from the distal end of the roll paper spindle 15. A round spacer 17 for adjusting the roll paper 11*a* width is removably installed at the base of the roll paper spindle 15, and different widths of roll paper 11*a* can be installed referenced to the front open end as seen in FIG. 1. When fanfold paper is used, the fanfold paper is stored in the rectangular space 18 formed by the base plate 13 and paper holder 14.

In at least one embodiment, the recording paper 11 is used to print baggage tags and boarding passes such as used in airports, for example. In this case, label paper having labels of a specific length affixed along the length of a liner of a constant width, for example, can be used as roll paper 11*a*. Fanfold paper could have individual baggage tags or boarding passes (slips) folded together in a stack. Baggage tags and boarding passes (slips) may be printed one at a time, or multiple slips could be printed continuously when the passenger has flight transfers or there is a group of people. A radio frequency identification (RFID) tag storing specific information may also be embedded to the leading end part of the label paper, for example. In this case, the recording paper 11 may be card stock.

Figure 2:
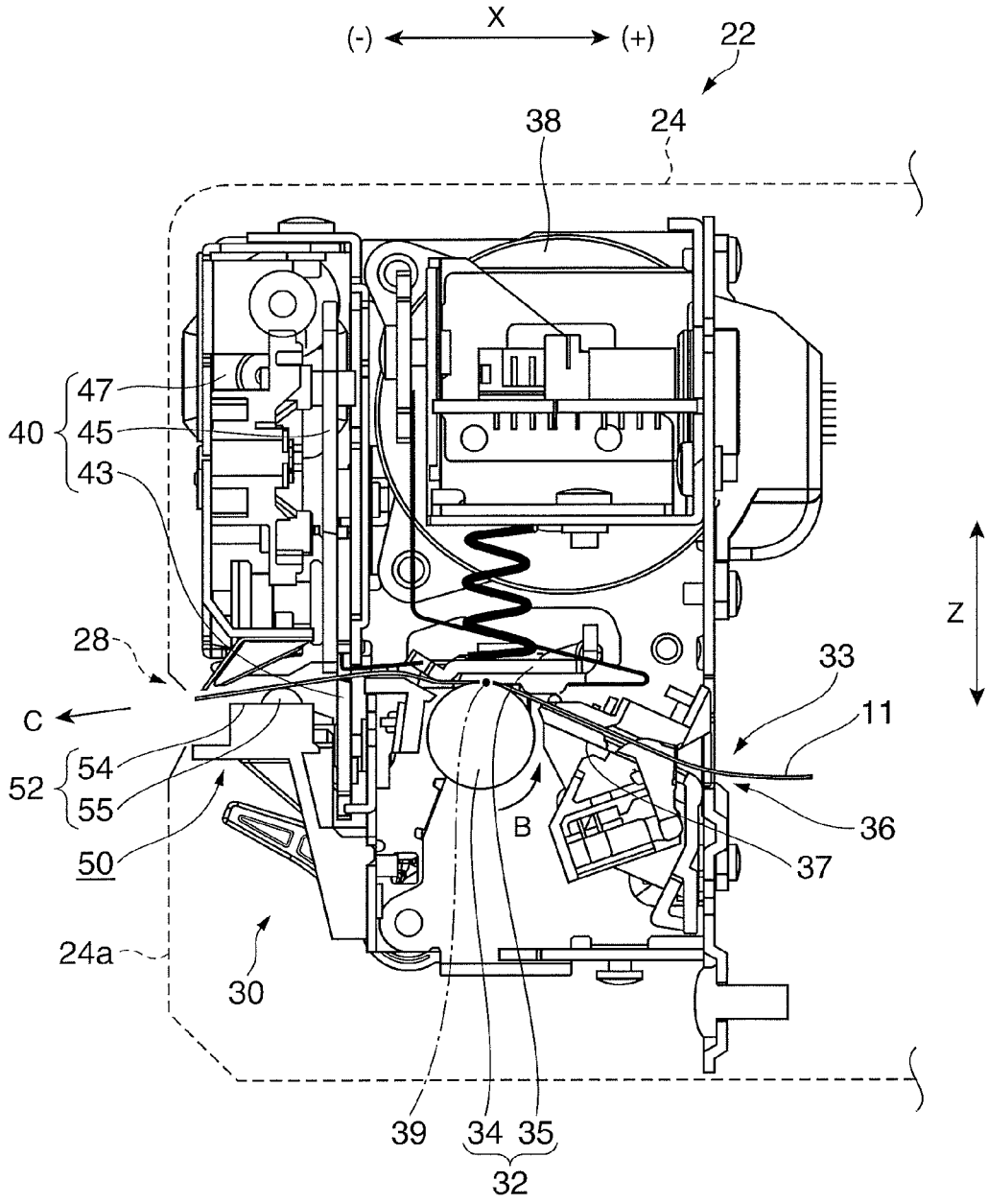
FIG. 2 is a section view of a main part of the print mechanism.

A printer according to this embodiment of the disclosure is described next with reference to FIG. 1 and FIG. 2. FIG. 2 is a section view showing the main part of a print mechanism 30. The x-axis and z-axis in FIG. 2 indicate the same directions as the x-axis and z-axis in FIG. 1. Note that a thermal printer that prints information on thermal recording paper (recording paper 11) is described as an example of the printer below.

The printer 20 shown in FIG. 1 has an outside case 22, a print mechanism 30 (FIG. 2), and a control unit not shown. The outside case 22 is box shaped and longer on the x-axis. The outside case 22 includes a main case 23, front case 24, cover 25, and rear case 26. The main case 23 is the part that is the base of the outside case 22, and has other case members and the paper feed unit 12 described below attached thereto in addition to the outside case 22.

The front case 24 is attached to the main case 23 at the opposite end of the printer 20 as the paper feed unit 12. A rectangular paper exit 28 that is longer in the y-axis direction is formed to the front 24*a* of the front case 24 as seen from the x-axis. The print mechanism 30 described below is housed inside the front case 24.

The cover 25 covers the paper feed path 33 of the roll paper 11*a*, and can open and close in the direction of arrow A pivoting on the end 25*a* at the front of the printer 20. The inside of the cover 25 functions to guide the recording paper 11, and may also house a reader not shown that reads information stored in the RFID tag noted above, for example.

The rear case 26 is disposed proximate to the paper feed unit 12 side of the printer 20, and has a rectangular paper entrance 29 that is longer in the y-axis direction formed substantially opposite the paper exit 28 in the front case 24.

As shown in FIG. 2, the print mechanism 30 is housed inside the front case 24 of the outside case 22, and includes a paper feed mechanism 32, printhead 35, and a paper discharge device 50 including an automatic cutter 40.

The paper feed mechanism 32 conveys continuous recording paper 11 through the paper feed path 33 inside the printer 20. The paper feed mechanism 32 includes a platen roller 34 disposed to a specific position on the paper feed path 33, and a thermal printhead 35 disposed opposite the platen roller 34. Because a thermal printer is used as an example of the printer in this embodiment, the paper feed mechanism 32 also functions to print information on the recording paper 11.

A paper entrance 36 is formed at the (+) x-axis side of the paper feed mechanism 32. The recording paper 11 is supplied through this paper entrance 36 into the printer, and is held with pressure applied thereto between the printhead 35 and platen roller 34. A paper guide 37 for guiding the recording paper 11 is disposed proximate to the upstream end of the paper feed path 33 from the paper entrance 36 to the printhead 35 and platen roller 34.

Drive torque from a paper feed motor 38 is transferred through a geared transmission mechanism not shown, for example, to the platen roller 34. When the platen roller 34 turns forward (direction of arrow B in FIG. 2), the recording paper 11 is conveyed forward (from the (+) x-axis side to the (−) x-axis side) by the rotation through the paper feed path 33. When the platen roller 34 turns in reverse (opposite the direction of arrow B), the recording paper 11 is reversed. Note that the conveyance direction that feeds the recording paper 11 toward the paper exit 28 (the conveyance direction of the recording paper 11 when printing, indicated by arrow C in FIG. 1 and FIG. 2) is the normal conveyance (paper feed) direction.

The printhead 35 has a heat unit 39 for heating the recording paper 11 and printing disposed to the side facing the platen roller 34. This heat unit 39 is formed in a line in the y-axis direction. When printing, the heat unit 39 part of the printhead 35 is set opposite the platen roller 34, and the desired heat elements in the group of plural heat elements constituting the heat unit 39 are selectively heated while conveying the recording paper 11 between the heat unit 39 and platen roller 34. Because the surface of the recording paper 11 is coated with a thermal coating, the part heated by a driven heat element changes color and forms a dot. This is controlled by a control unit not shown, and information is printed on the surface of the recording paper 11 based on the print data.

The recording paper 11 on which information is printed is then discharged through the paper discharge device 50 including the automatic cutter 40 described below to the outside of the printer from the paper exit 28 at the (−) x-axis end of the print mechanism 30.

Figure 3:
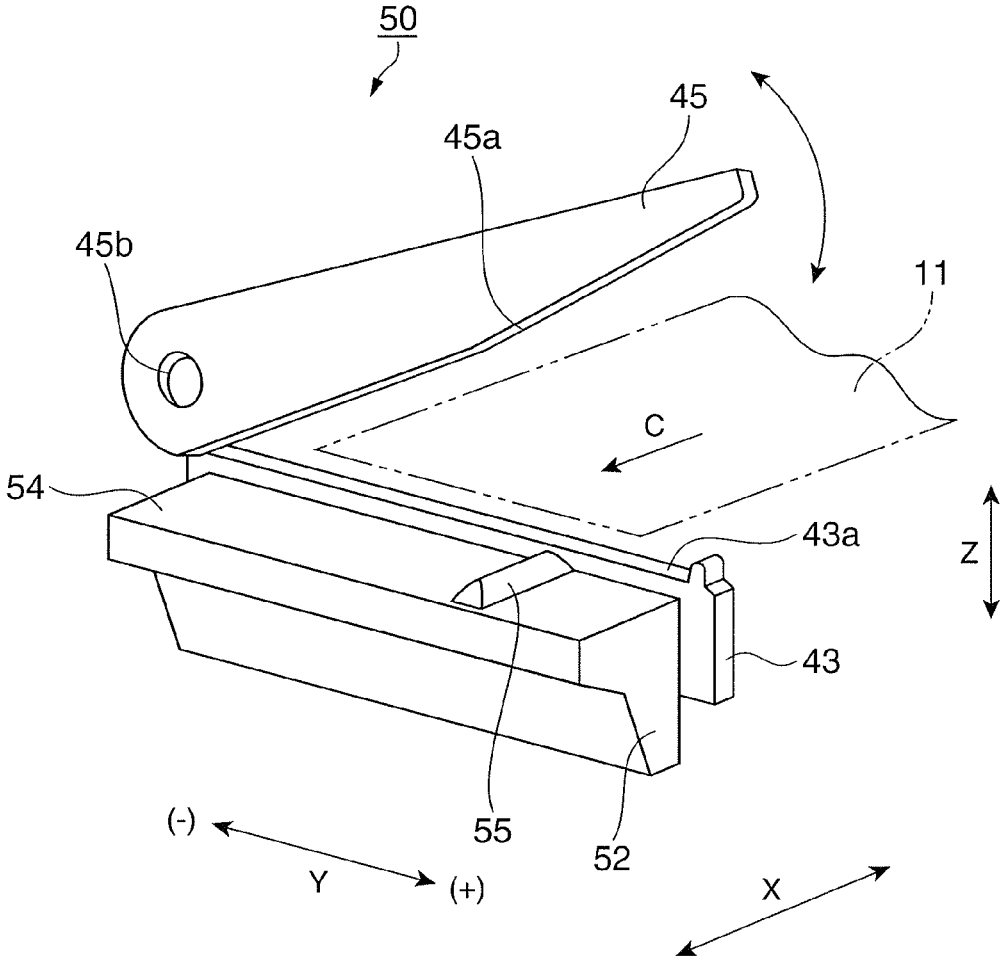
FIG. 3 depicts the paper discharge device.

The paper discharge device 50 is described next with reference to FIG. 2 and FIG. 3. FIG. 3 depicts the paper discharge device 50, and more specifically is an oblique view thereof from the side to which the paper is discharged. The x-axis, y-axis, and z-axis in FIG. 3 are oriented in the same directions as the x-axis, y-axis, and z-axis, respectively, in FIG. 1.

As shown in FIG. 2, the paper discharge device 50 is located between the paper feed mechanism 32 and the front case 24 of the outside case 22. More specifically, the paper feed mechanism 32, paper discharge device 50, and front case 24 (outside case 22) are disposed in order along the x-axis in FIG. 2 to the common paper feed path 33. The paper discharge device 50 includes the automatic cutter 40 and a paper stage 52.

Figure 5:
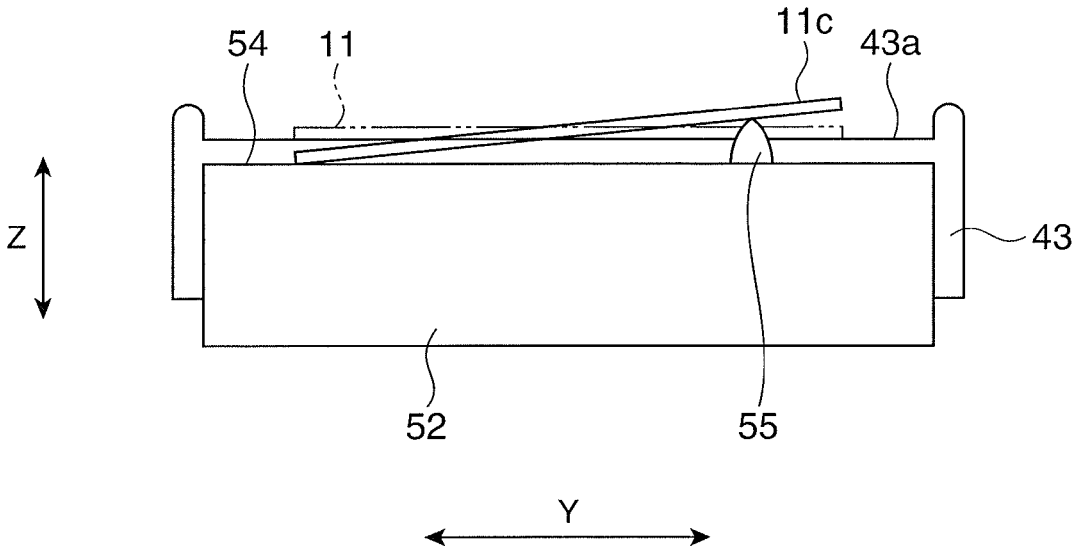
FIG. 5 depicts the paper discharge operation.

The automatic cutter 40 functions to cut the continuous recording paper 11 on which desired information is printed by the printhead 35 to the desired length, creating a slip 11*c* (see FIG. 5). A scissor-type automatic cutter that pivots one knife in the direction to and away from another knife is described as an example of the automatic cutter 40 in this embodiment of the disclosure. Note that there are multiple types of automatic cutters 40, including cutters that move one knife to and away from another knife with a reciprocating linear motion.

As shown in FIG. 2 and FIG. 3, the automatic cutter 40 includes a fixed knife 43, movable knife 45, cutter drive motor 47, and a movable knife drive transmission mechanism not shown. The fixed knife 43 is a basically rectangular plate with a straight cutting edge 43*a* formed on one long side. The fixed knife 43 is affixed with the cutting edge 43*a* extending on the y-axis below the paper feed path 33 and the z-axis. The movable knife 45 is a plate with a substantially straight cutting edge 45*a* formed on one long side, and has a pivot axis 45*b* near one end. The pivot axis 45*b* is located on the y-axis outside the range that the recording paper 11 travels.

The automatic cutter 40 has a cutter drive motor 47, and drive power from the cutter drive motor 47 is transmitted through a movable knife drive transmission mechanism not shown to the movable knife 45. As a result, the movable knife 45 can pivot on the pivot axis 45*b*, and, by operating the cutter drive motor 47, can pivot in the direction to and away from the fixed knife 43, cutting the recording paper 11 set between the fixed knife 43 and movable knife 45. Note that a slip 11*c* (FIG. 5) of the desired length can be produced by synchronizing operation of the automatic cutter 40 with the conveyance operation of the paper feed mechanism 32.

The paper stage 52 is made from a suitable material such as plastic, and, as shown in FIG. 2 and FIG. 3, is disposed spanning the gap between the paper feed mechanism 32 and the front case 24 of the outside case 22, becoming part of the paper feed path 33. The paper stage 52 has a rectangular paper guide surface 54 of which the longer side is the paper width direction (y-axis) of the paper feed path 33, and the shorter side is the conveyance direction (x-axis). The top of the paper guide surface 54 is slightly lower on the z-axis than the position of the cutting edge 43*a* of the fixed knife 43. The paper guide surface 54 functions to guide the bottom of the recording paper 11 conveyed through the paper feed path 33, and to temporarily hold the slip 11*c* (FIG. 5) cut to a desired length by the automatic cutter 40 at the paper exit 28 of the front case 24.

The paper guide surface 54 has a protruding part 55 formed thereon at a position away from the center on the y-axis. In this embodiment the protruding part 55 is formed at a position away from the center of the width of the recording paper 11, such as near one end of the paper guide surface 54 on the y-axis. A configuration having the protruding part 55 formed near the (+) y-axis end is described below. This position is a position near where the (+) y-axis edge of the recording paper 11 passes when the recording paper 11 passes over the paper guide surface 54.

In at least some embodiments, the protruding part 55 is shaped like the bottom of a boat extending on the x-axis (a convex shape formed in the paper conveyance direction with inclined sides that rise on the z-axis), that is, a shape that reduces sliding resistance on both the x-axis and y-axis. The height of the protruding part 55 on the z-axis is above the position of the cutting edge 43*a* of the fixed knife 43 in this embodiment, but the disclosure is not so limited.

Figure 4:
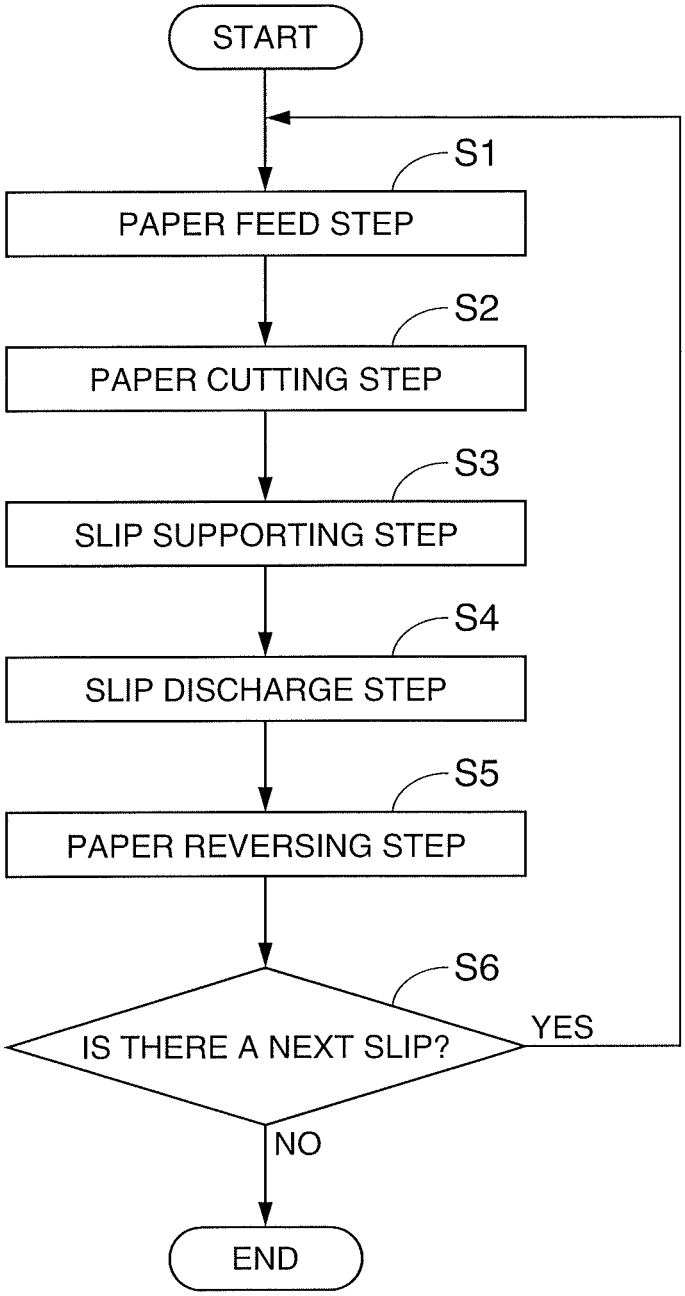
FIG. 4 is a flow chart of the paper discharge operation.

The paper discharge operation of the printer 20 using this paper discharge device 50 is described next with reference to FIG. 4 and FIG. 5. FIG. 4 is a flow chart of the paper discharge operation, and FIG. 5 depicts the paper discharge operation. The y-axis and z-axis in FIG. 5 denote the same directions as the y-axis and z-axis in FIG. 1.

As shown in FIG. 4, in the paper feed step S1, the recording paper 11 is conveyed forward (direction of arrow C) through the paper feed path 33 while information is printed thereon by the print mechanism 30 shown in FIG. 2. The conveyed recording paper 11 then reaches the automatic cutter 40 at the downstream end of the paper feed path 33.

Next, in the paper cutting step S2, the recording paper 11 on which information was printed is cut to the desired length by the automatic cutter 40, producing a slip 11*c*. More specifically, the recording paper 11 positioned between the fixed knife 43 and movable knife 45 of the automatic cutter 40 is cut by the pivoting action of the movable knife 45 to the fixed knife 43. The length of the cut recording paper 11 is determined by the number of steps the paper feed motor 38 is driven, for example.

In the slip holding step S3, the cut slip 11*c* is held at the paper guide surface 54 of the paper stage 52 and the paper exit 28 in the front case 24 of the outside case 22 as shown in FIG. 2 and FIG. 3. During this step, as shown in FIG. 5, the top of the paper guide surface 54 is lower on the z-axis than the cutting edge 43*a* of the fixed knife 43, and the protruding part 55 of the paper guide surface 54 is closer to one edge of the slip 11*c* on the y-axis. As a result, the cut end of the slip 11*c* on the upstream side is supported at an angle as indicated by the solid line in FIG. 5. More specifically, the slip 11*c* is held with the cut end on the upstream side of the slip 11*c* blocking the leading end of the conveyed recording paper 11 indicated by the dashed line at the automatic cutter 40.

In the slip discharge step S4, the recording paper 11 held between the platen roller 34 and printhead 35 of the paper feed mechanism 32 is conveyed a specific amount forward (the direction of arrow C). As described above, the slip 11*c* is held with the upstream end of the cut slip 11*c* blocking the leading end of the conveyed portion of the recording paper 11 at the automatic cutter 40. When conveyed forward, the recording paper 11 therefore moves forward while the leading end of the recording paper 11 pushes against the upstream end of the cut slip 11*c*. As a result, the slip 11*c* (which is held by the paper guide surface 54 of the paper stage 52 and the paper exit 28 in the front case 24 of the outside case 22) is pushed out and discharged from the paper exit 28 in the outside case 22.

The paper feed distance in this case can be adjusted according to the size of the slip 11*c* and how many slips 11*c* are printed continuously, and the relative positions of the paper stage 52 and the paper exit 28 in the outside case 22. A stacker or other storage unit for holding a certain number of discharged slips 11*c* could also be provided outside the paper exit 28 of the outside case 22 in some embodiments. In this case, the printed slips 11*c* may be conveyed just far enough to reliably deposit the slips 11*c* in the stacker. A paper detector using a photosensor is disposed proximate to the paper exit 28 or stacker to check if the slip 11*c* was reliably discharged or reliably stored in the stacker. Note that the configuration and location of the stacker are not particularly limited, and any appropriate stacker can be used.

In the paper reversing step S5, the platen roller 34 is driven in reverse to reverse the recording paper 11 after being conveyed forward a specific distance in step S4. The recording paper 11 then pauses after the leading end of the recording paper 11 reaches a position upstream from the automatic cutter 40.

Whether there is another slip 11*c* to print is then determined in step S6. If there is a next slip 11*c* to print (Yes), operation returns to the paper feed step S1 and the operation described above repeats. If there is not another slip 11*c* to print (No), the paper discharge operation ends.

The paper discharge device 50 described above can support the slip 11*c* produced by the automatic cutter 40 on the paper guide surface 54 so that part of the recording paper 11 conveyed by the paper feed mechanism 32 is held at an angle by the paper guide surface 54 and protruding part 55. As a result, when the paper feed mechanism 32 advances the recording paper 11, the leading end of the recording paper 11 can push the cut upstream end of the slip 11*c*. As a result, the slip 11*c* is pushed to the outside from the vicinity of the automatic cutter 40 of the printer 20 and the paper guide surface 54. The slip 11*c* can therefore be reliably discharged without providing a special mechanism.

The paper discharge device 50 described above can reliably discharge slips 11*c* to the outside even if the operator forgets to remove the slip 11*c*. The slips 11*c* can therefore be prevented from accumulating near the automatic cutter 40 and near the paper guide surface 54. As a result, accumulated slips 11*c* can be prevented from interfering with the movable knife 45 of the automatic cutter 40, and incomplete cuts and production of paper slivers by recutting a slip 11*c* can be reduced. High reliability paper discharge can therefore be achieved.

The paper discharge device 50 enables adjusting the paper feed distance of the recording paper 11 by the paper feed mechanism 32, that is, the conveyance distance of the slip 11*c*. Plural slips 11*c* of different sizes and continuous printing of slips 11*c* can therefore be easily accommodated, and paper discharge with high practical utility can be achieved.

Slips 11*c* can be delivered to the stacker and reliably stored in the stacker with the paper discharge device 50 described above regardless of the number of continuously printed slips 11*c* by adjusting the paper feed distance of the recording paper 11 by the paper feed mechanism 32.

The protruding part 55 of the foregoing paper discharge device 50 is formed as a shape, such as the bottom of a boat extending in the paper feed direction, which reduces sliding resistance. As a result, the recording paper 11 conveyance load and biasing of the conveyance load can therefore be reduced, and the recording paper 11 can be conveyed consistently.

Figure 6:
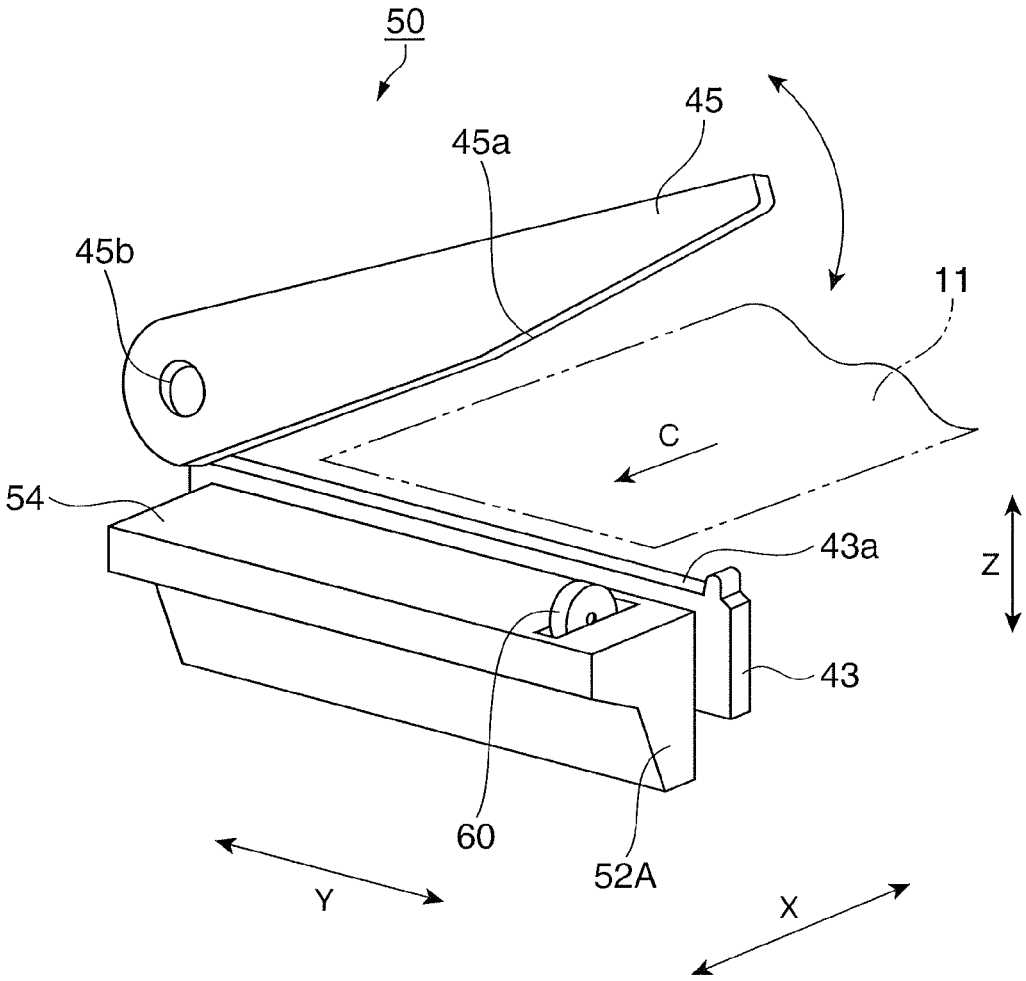
FIG. 6 depicts a paper discharge device according to an embodiment of the disclosure.

A paper discharge device 50 according to another embodiment of the disclosure is described next with reference to FIG. 6. FIG. 6 depicts a paper discharge device 50 according to embodiments of the disclosure. This embodiment is an embodiment using a different protruding part 55. Note that parts and content of this embodiment that are the same as the first embodiment are identified by like reference numerals and further description thereof is omitted.

As shown in FIG. 6, the paper discharge device 50 according to the embodiment of the disclosure has an automatic cutter 40 and paper stage 52A. As in the previously described embodiment, the paper stage 52A has a rectangular paper guide surface 54 of which the long side is the paper width direction (y-axis) of the paper feed path 33, and the short side is the conveyance direction (x-axis). The paper guide surface 54 is slightly lower on the z-axis than the position of the cutting edge 43*a* of the fixed knife 43. The paper guide surface 54 functions to guide the bottom of the recording paper 11 conveyed through the paper feed path 33, and to temporarily hold the slip 11*c* (FIG. 5) cut to a desired length by the automatic cutter 40 at the paper exit 28 of the front case 24.

The protruding part 55 of the paper guide surface 54 in this embodiment is a wheel 60 that can rotate in the paper conveyance direction oriented toward a position away from the center on the y-axis. The wheel 60 is disposed proximate to a position near one end of the paper guide surface 54 on the y-axis. In this embodiment, the wheel 60 is located near the (+) y-axis end. This position is a position near where the (+) y-axis edge of the recording paper 11 passes when the recording paper 11 passes over the paper guide surface 54. The wheel 60 is supported on a pin, for example, and rotates to reduce the load in the conveyance direction of the recording paper 11 conveyed in the x-axis direction. The height of the outside of the wheel 60 is preferably higher than the height of the cutting edge 43*a* of the fixed knife 43, but the disclosure is not so limited.

A wheel 60 is disposed as the protruding part 55 to the paper discharge device 50 according to embodiments of the disclosure. Because the wheel 60 rotates freely, the wheel 60 functions as the protruding part 55, can therefore reduce the recording paper 11 conveyance load and biasing of the conveyance load, and the recording paper 11 can be conveyed consistently.

Preferred embodiments of the disclosure are described above, and can be varied in many ways without departing from the scope of the accompanying claims. Examples of some variations are described below.

The printer 20 is described in the foregoing embodiments using a thermal printer as an example. The printer 20 could, however, be an inkjet printer or dot impact printer. The protruding part 55 described above is described as being shaped like the bottom of a boat extending in the conveyance direction, or being a wheel 60 that can rotate freely in the conveyance direction, but the disclosure is not so limited. For example, the protruding part 55 could be curved, such as a hemisphere, or any other configuration that reduces sliding resistance in the conveyance direction.

The upstream cut end of the slip 11*c* is supported in the above described embodiments blocking part of the leading end of the conveyed recording paper 11 at the automatic cutter 40. In other words, part of the upstream cut end of the slip 11*c* cut by the automatic cutter 40 is supported by the protruding part 55 at a position where the upstream cut end will contact the leading end of the recording paper 11 conveyed next by the paper feed mechanism 32. As a result, the upstream cut end of the slip 11*c* cut by the automatic cutter 40 will be pushed by the downstream cut end of the following recording paper 11 conveyed by the paper feed mechanism 32, and the slip 11*c* will be pushed out. The height of the protruding part 55 on the z-axis is set higher than the position of the cutting edge 43*a* of the fixed knife 43.

In some embodiments, the height on the z-axis of the top of the protruding part is set to a height that is lower than the cutting edge of the fixed knife 43 of the automatic cutter 40 disposed below on the z-axis, and higher than the height of the cutting edge of the fixed knife 43 minus the thickness of the recording paper on the z-axis. This configuration enables contacting the upstream cut end of the slip 11*c* supported by the protruding part 55 even when the recording paper 11 is discharged horizontally from the paper exit 28 by the paper feed mechanism 32.

The height on the z-axis of the top of the protruding part is higher the cutting edge of the lower fixed knife 43 of the automatic cutter 40 on the z-axis in some embodiments. As a result, recording paper 11 discharged from the paper exit 28 by the paper feed mechanism 32 can more reliably contact the upstream cut end of the slip 11*c*.

What is claimed is:

1. A paper discharge device comprising:

a paper feed mechanism that is configured to convey recording paper;

an automatic cutter that has a drive unit and is configured to cut recording paper conveyed by the paper feed mechanism into a slip by drive power from the drive unit; and a paper guide unit that has a paper guide surface configured to support the slip cut by the automatic cutter, and has a protruding part that is disposed proximate to the guide surface and is configured to support part of the cut end of the slip at an angle with respect to the paper conveyed by the paper feed mechanism for causing the part of the cut end to contact the recording paper conveyed by the paper feed mechanism, wherein the protruding part is a wheel configured to rotate freely in the recording paper conveyance direction.

2. The paper discharge device described in claim 1, wherein:

the automatic cutter has a first knife disposed vertically below the recording paper conveyed by the paper feed mechanism, and a second knife disposed vertically above the recording paper conveyed by the paper feed mechanism; and the first knife or the second knife is driven by the drive unit.

3. The paper discharge device described in claim 2, wherein:

the guide surface is disposed vertically lower than the cutting edge of the vertical top of the first knife of the automatic cutter; and the protruding part protrudes vertically up, and is configured to position part of the cut end of the slip vertically higher than the cutting edge of the vertical top of the first knife.

4. The paper discharge device described in claim 2, wherein:

the vertical top part of the protruding part is disposed to a position vertically higher than the cutting edge of the vertical top of the first knife.

5. The paper discharge device described in claim 1, wherein:

the protruding part is disposed to a position outside the center part of the recording paper in the direction perpendicular to vertical and the recording paper conveyance direction.

6. The paper discharge device described in claim 1, wherein:

the protruding part has a tapered side that extends in the recording paper conveyance direction and slopes up vertically.

7. The paper discharge device described in claim 1, wherein:

the protruding part is a hemispherical protrusion.

8. A paper discharge method, comprising steps of:

conveying recording paper by a conveyance mechanism to an automatic cutter driven by a drive unit;

cutting the conveyed recording paper with the automatic cutter and forming a slip;

supporting the cut slip at an angle with respect to the paper conveyed by the conveyance mechanism, by a paper guide having a guide surface and a protruding part disposed proximate to the guide surface; and pushing part of the cut end of the slip supported by the paper guide with the recording paper conveyed by the conveyance mechanism, and discharging the slip, wherein the protruding part is a wheel configured to rotate freely in the recording paper conveyance direction.

9. The paper discharge method described in claim 8, further comprising a step of:

conveying the recording paper that pushed the slip in the reverse of the direction discharging the slip by the conveyance mechanism.

10. The paper discharge method described in claim 9, wherein:

the cut end of the recording paper is conveyed from the cutting position of the automatic cutter in the reverse of the direction discharging the slip, when the recording paper is conveyed by the conveyance mechanism in the reverse of the direction discharging the slip.

11. A printer comprising:

a paper feed mechanism configured to convey recording paper;

a printhead configured to print on the recording paper conveyed by the paper feed mechanism;

an automatic cutter that has a drive unit and configured to cut the recording paper conveyed by the paper feed mechanism into a slip by drive power from the drive unit; and a paper guide unit that has a paper guide surface configured to support the slip cut by the automatic cutter, and a protruding part that is disposed proximate to the guide surface and supports part of the cut end of the slip at an angle with respect to the paper conveyed by the paper feed mechanism for causing the part of the cut end to contact the recording paper conveyed by the paper feed mechanism, wherein the protruding part is a wheel configured to rotate freely in the recording paper conveyance direction.

12. The printer described in claim 11, wherein:

the automatic cutter has a first knife disposed vertically below the recording paper conveyed by the paper feed mechanism, and a second knife disposed vertically above the recording paper conveyed by the paper feed mechanism; and the first knife or the second knife is configured to be driven by the drive unit.

13. The printer described in claim 12, wherein:

the guide surface is disposed vertically lower than the cutting edge of the vertical top of the first knife of the automatic cutter; and the protruding part protrudes vertically up, and positions part of the cut end of the slip vertically higher than the cutting edge of the vertical top of the first knife.

14. The printer described in claim 12, wherein:

the vertical top part of the protruding part is disposed to a position vertically higher than the cutting edge of the vertical top of the first knife.

15. The printer described in claim 11, wherein:

the protruding part is disposed to a position outside the center part of the recording paper in the direction perpendicular to vertical and the recording paper conveyance direction.

16. The printer described in claim 11, wherein:

the protruding part has a tapered side that extends in the recording paper conveyance direction and slopes up vertically.

* * * * *